US010072455B2

(12) United States Patent
Smith

(10) Patent No.: US 10,072,455 B2
(45) Date of Patent: Sep. 11, 2018

(54) TEMPORARY DOOR LATCH DEVICE FOR A PRE-HUNG DOOR AND CASING

(71) Applicant: B. Jack Smith, Bixby, OK (US)

(72) Inventor: B. Jack Smith, Bixby, OK (US)

( * ) Notice: Subject to any disclaimer, the term of this patent is extended or adjusted under 35 U.S.C. 154(b) by 503 days.

(21) Appl. No.: 14/792,182

(22) Filed: Jul. 6, 2015

(65) Prior Publication Data

US 2017/0009499 A1 Jan. 12, 2017

(51) Int. Cl.

| | |
|---|---|
| ***E05C 1/02*** | (2006.01) |
| ***E06B 3/00*** | (2006.01) |
| ***E05C 19/18*** | (2006.01) |
| ***E05B 17/00*** | (2006.01) |

(52) U.S. Cl.

CPC ..... *E06B 3/00* (2013.01); *E05B 17/0012* (2013.01); *E05C 19/184* (2013.01)

(58) Field of Classification Search

CPC ..... F16B 21/086; F16B 21/06; F16B 37/043; F16B 21/02; F16B 21/082; F16B 5/0258; Y10T 403/7176; Y10T 428/24017

USPC ..... 292/240

See application file for complete search history.

(56) References Cited

U.S. PATENT DOCUMENTS

| | | | | |
|---|---|---|---|---|
| 3,125,366 | A | 3/1964 | Cetrone et al. | |
| 3,593,458 | A | 7/1971 | Wahlfeld et al. | |
| 4,109,948 | A | 8/1978 | Potter et al. | |
| D319,007 | S | 8/1991 | Rogers et al. | |
| 5,159,782 | A | 11/1992 | Sales | |
| 5,562,315 | A | 10/1996 | Sales | |
| 5,787,639 | A * | 8/1998 | Lamore, Jr. | E05B 17/0012 49/380 |
| 6,170,198 | B1 * | 1/2001 | Staples | E06B 7/00 49/380 |
| 6,676,177 | B2 * | 1/2004 | Daoud | E05C 19/06 292/202 |
| 6,874,827 | B1 | 4/2005 | Dodson | |
| 7,121,045 | B2 | 10/2006 | Massey et al. | |
| 7,213,371 | B1 | 5/2007 | Vanderpan | |
| 8,052,178 | B2 | 11/2011 | MacDonald et al. | |
| 8,245,448 | B2 | 8/2012 | Crane et al. | |
| 2004/0201228 | A1 | 10/2004 | L'Heureux et al. | |
| 2014/0306461 | A1 | 10/2014 | Luizzi et al. | |

* cited by examiner

*Primary Examiner* — Mark A Williams

(74) *Attorney, Agent, or Firm* — Head, Johnson, Kachigan & Wilkinson, PC

(57) ABSTRACT

A temporary door latch device for a pre-hung door and casing. The door has a door lock cylinder opening and a door latch opening and the casing has a latch bolt opening. The device includes a female portion having a pair of opposed and spaced apart resilient fingers, each of said fingers having a plurality of inwardly extending teeth thereon. The female portion is receivable in the door lock cylinder opening and the door latch opening. The male portion has a pair of opposed and spaced apart fingers, each of the fingers having a plurality of teeth thereon. The male portion is receivable in the latch bolt opening and the door latch opening. The teeth on the female portion engage the teeth on the male portion in one orientation and are disengaged in another orientation.

8 Claims, 7 Drawing Sheets

TEMPORARY DOOR LATCH DEVICE FOR A PRE-HUNG DOOR AND CASING

FIELD OF THE INVENTION

The present invention relates in general to a temporary door latch device for a pre-hung door and casing, for retaining a door and casing in alignment during assembly, shipping and installation, and for installing of the pre-hung door and casing unit.

PRIOR ART

In the past, the standard way to install a door in either new or remodeled construction was to prepare and construct a doorway casing and jamb. The casing and jamb would have to be plumb and square. A door would then be sized and fitted to the opening constructed, recesses would be made for hinges, and the hinges would be attached to both the door casing and the door. An opening would be drilled or cut from one side of the door to the other for a door cylinder opening and another opening would be drilled or cut from an edge of the door to the door cylinder opening for a door latch opening. Finally, the door lock hardware would be installed.

Increasingly, pre-hung door units are utilized which are already built and assembled having a door casing with the door fitted thereto already assembled with hinges. A pre-drilled or pre-cut hole or opening is already supplied for a door cylinder and an opening from an edge of the door into the door cylinder opening is made for a latch bolt opening. An aligned opening is also made through the door casing adjacent the latch bolt opening.

Pre-hung door shops, millwork shops, and certain manufacturers supply these pre-hung door units with casing or jambs. The door jambs include two vertical, opposed side jambs and a header fitted across the top of the side jambs. A temporary strip or a permanent seal may also be fastened across the bottom of the jambs. The door and casing unit is prepared for installation of the handle and lock set but is not fitted with the knobs, striker plates, and latches since these are selected by the building owner or home owner and then installed later on site.

The door and casing assembly requires a fastener or fasteners to hold the door in a closed position relative to the door jamb during transportation, shipment and installation at the worksite. Finally, any fastener or fasteners must be removed prior to installation of the door hardware.

Straps or other packaging have been used in the past to hold the door and the door casing together. Alternatively, a nail will be driven through the casing into the edge of door to securely hold the door during shipping. The nail or nails deface the edge of the door and must be removed prior to installation.

Various other proposals have been made in the past. For example, Crane et al. (U.S. Pat. No. 8,245,448) discloses a door plug 40 for a pre-hung door having a bolt member 42 and a threaded fastener 44. The bolt member includes a collar 46 and a cylindrical shaft 48. FIG. 6A shows an alternate fastener 244' with resilient pawls 270B on extending tip members 271B. The fastener is removed by counter-clockwise rotation of the fastener 244'. It is necessary to thread the fastener into the bore and, likewise unthread the fastener for removal. The fastener does not appear to be accessible once the casing has been placed over the door jambs.

MacDonald et al. (U.S. Pat. No. 8,052,178) discloses a temporary door lock assembly 20 having a rosette 34 with a base plate 36 which mates with an inside plate 112. A barrel 62 has a hollow interior to accept the bolt 58 telescopingly connected. A locking arm 84 moves the bolt between an extended and retracted position. The assembly 20 would be required to be removed prior to painting or staining of the door.

Lamore, Jr. (U.S. Pat. No. 5,787,639) discloses a door hanger bolt assembly with a stud element 19 received in a bolt 16. A shim 16 is placed between the door and the frame. A cycloid wedge 37 is inserted into the lockset hole and the stud with barbs 20 is driven into the door edge. The stud with barbs 20 would not appear to be accessible once any casing or frame has covered the jambs.

In addition, the pre-hung door and casing are typically stained or painted before the hardware, such as the door cylinder latches and handles, are installed.

Accordingly, it would be desirable to be able to stain or paint the door and casing without interference from the door hardware and without interference from any temporary fastener or fasteners.

Additionally, during construction of the building or home, after installation of the door and casing, but before installation of the door lock hardware, the door will typically freely swing in the casing with no restraint or control.

It would also be desirable to provide a temporary door latch device which can be utilized to readily move between a locked position to retain the door to the casing and an unlocked position to permit opening of the door, but the device could be removed prior to final installation of the door hardware.

Accordingly, it would be desirable to provide a temporary door latch device for a pre-hung door and casing which can be installed by simply inserting two component parts with no tools, and no damage to either the door or casing.

It would also be desirable to provide a temporary door latch device for a pre-hung door and casing that may be used to secure an unlock and thereafter resecure the door to the frame after installation of the door and casing, but before installation of the final hardware.

It would also be desirable to provide a temporary door latch device for a pre-hung door and casing having only two components wherein one component inserted through said latch bolt opening may be broken away after installation even if not accessible from the casing.

It would also be desirable to provide a temporary door latch device for a pre-hung door and casing having two components wherein the components may disengage and later re-engage by simple rotation of one of the components.

It would also be desirable to provide a temporary door latch device for a pre-hung door and casing having interlocking components that are self-aligning.

SUMMARY OF THE INVENTION

The present invention is directed to a temporary latch device for a pre-hung door and casing. The door includes a pre-drilled cylindrical opening for a door lock cylinder opening. The cylindrical door lock opening is in communication with a pre-drilled door latch opening which passes from the edge of the door into the door lock cylinder opening. A latch bolt opening passes through a side jamb and is aligned with a door latch opening.

A female portion has a pair of opposed and spaced apart resilient fingers with each of the fingers having a plurality of inwardly extending teeth thereon. The fingers, when installed, are receivable in the door lock cylinder opening and in the door latch opening.

A male portion has a pair of opposed and spaced apart fingers with each of the fingers having a plurality of outwardly facing teeth thereon. The male portion is receivable in the latch bolt opening and in the door latch opening. The teeth on the female portion engage the teeth on the male portion in a first rotational orientation so that the door is latched to the jamb of the casing.

The fingers of the female portion extend from an arcuate base which mates with the door lock cylinder opening.

In a preferred embodiment, the teeth on the fingers of the female portion each include an alignment groove. Each of the fingers of the male portion includes a tip or nose extending from the fingers which act to self-align the male and female portions with each other.

DETAILED DESCRIPTION OF THE PREFERRED EMBODIMENTS

The embodiments discussed herein are merely illustrative of specific manners in which to make and use the invention and are not to be interpreted as limiting the scope of the instant invention.

Figure 1:
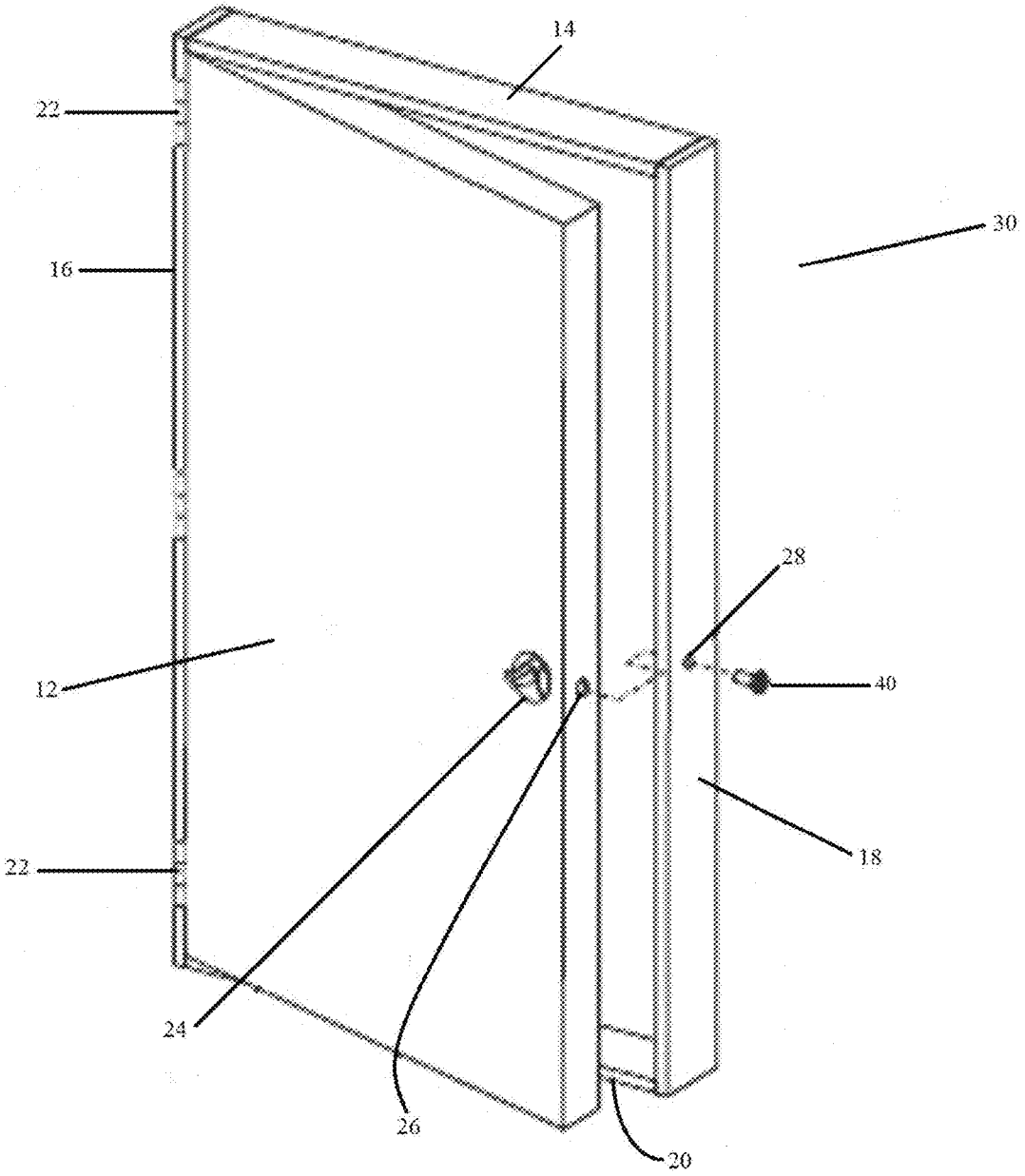
FIG. 1 is a perspective view of a pre-hung door and casing with the door slightly open for ease of viewing.

Referring to the drawings in detail, FIG. 1 illustrates a perspective view of a pre-hung door unit 30 consisting of a door 12 and a casing with the door slightly open for ease of viewing. The unit 30 includes casing having a top 14 and extending side jambs 16 and 18 along with an optional base 20. One side of the door 12 includes hinges 22 at a location near one edge of the door 12. Opposite the hinges 22, set back from the opposed edge, is a pre-drilled cylindrical opening for a door lock cylinder opening 24.

Once the pre-assembled door and the accompanying casing have been transported to the work site and installed, the present invention will be removed and a cylindrical lock and hardware (not shown in FIG. 1) will be installed to complete the construction. The cylindrical door lock opening 24 is in communication with a pre-drilled door latch opening 26 which passes from the edge of the door into the door lock cylinder opening 24.

In addition, a latch bolt opening 28 passes through the side jamb 18 and is aligned with the door latch opening 26.

Figure 2:
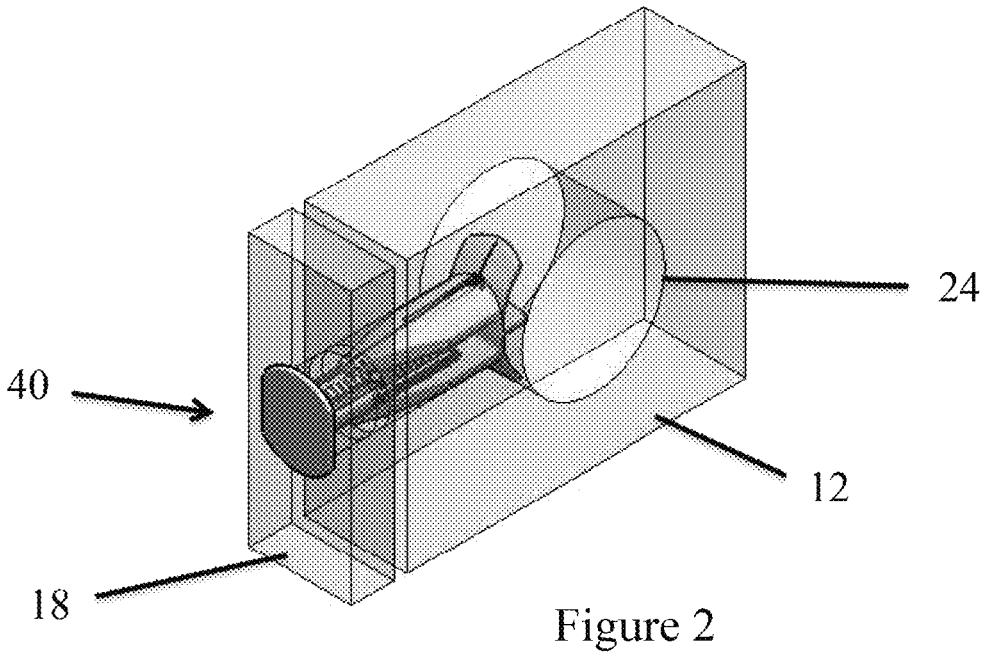
FIG. 2 illustrates a perspective view.
Figure 3:
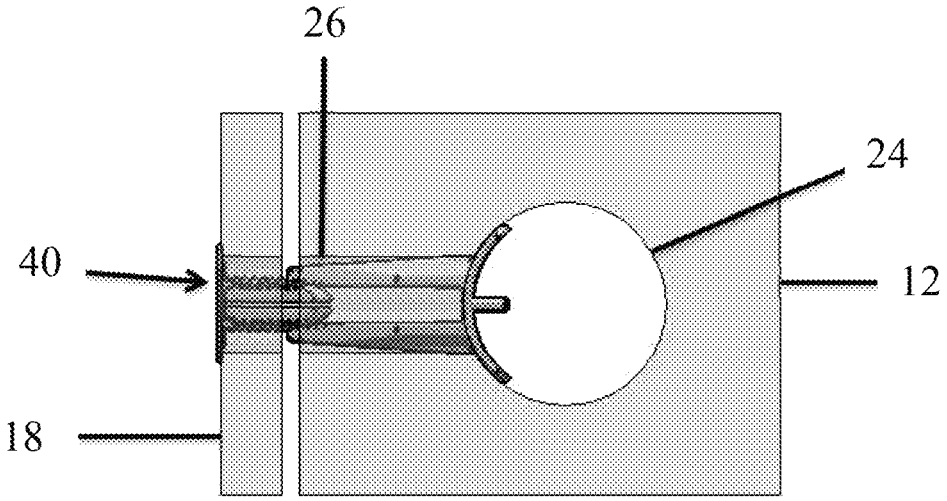
FIG. 3 illustrates a side view.
Figure 4:
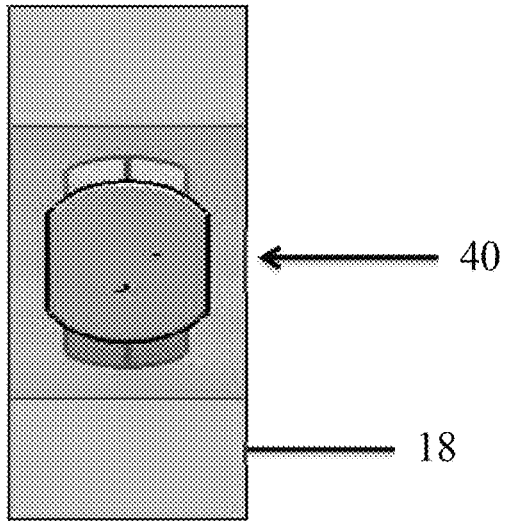
FIG. 4 illustrates an end view.
Figure 5:
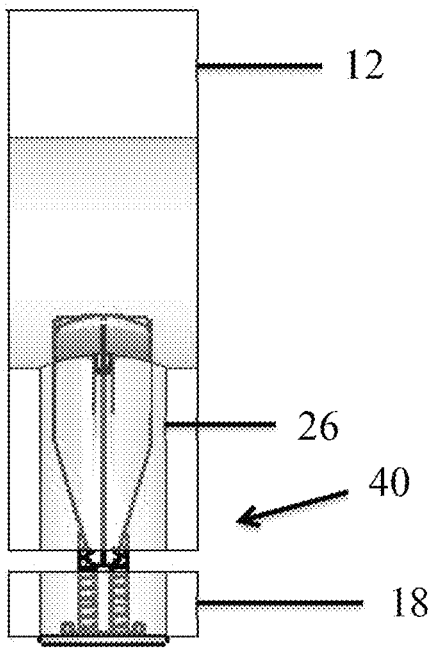
FIG. 5 illustrates a top view of a door with a side jamb showing the temporary door latch device of the present invention.

FIG. 2 illustrates a perspective view, FIG. 3 illustrates a side view, FIG. 4 illustrates an end view and FIG. 5 illustrates a top view of a door 12 with side jamb 18 with parts cut away for ease of viewing. A temporary door latch device 40 is shown in the engaged or latched position. A female portion 32 is shown inserted into the male portion 34.

As will be described in detail, the female portion 32 has a pair of opposed and spaced apart resilient fingers, each of the fingers having a plurality of inwardly extending teeth thereon. The fingers of the female portion 32, when installed, are receivable in the door lock cylinder opening 24 and in the door latch opening 26.

As will be described in detail, the male portion 34 has a pair of opposed and spaced apart fingers with each of the fingers having a plurality of outwardly facing teeth thereon. The male portion is receivable in the latch bolt opening 26 and in the door latch opening 26. The teeth on the female portion 32 engage the teeth on the male portion 34 in a first rotational orientation shown in FIGS. 2, 3, 4 and 5. When the female portion and male portion are engaged, the door 12 is latched to the side jamb 18 of the casing.

Figure 6:
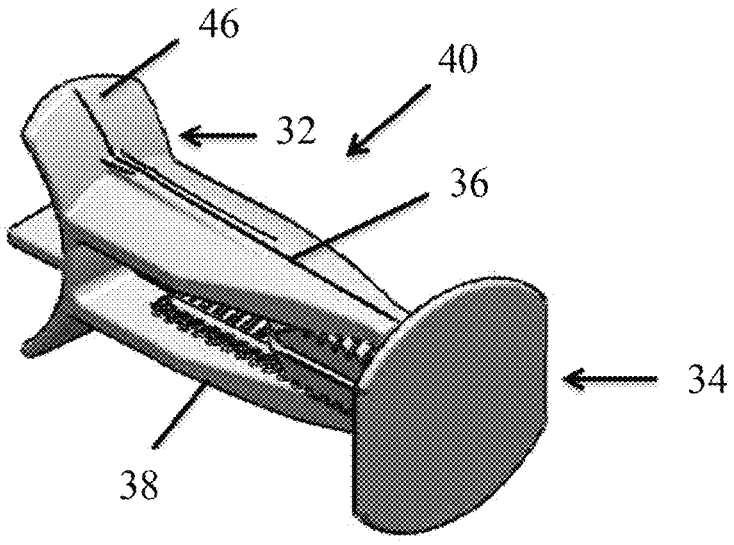
FIG. 6 illustrates a perspective view.
Figure 7:
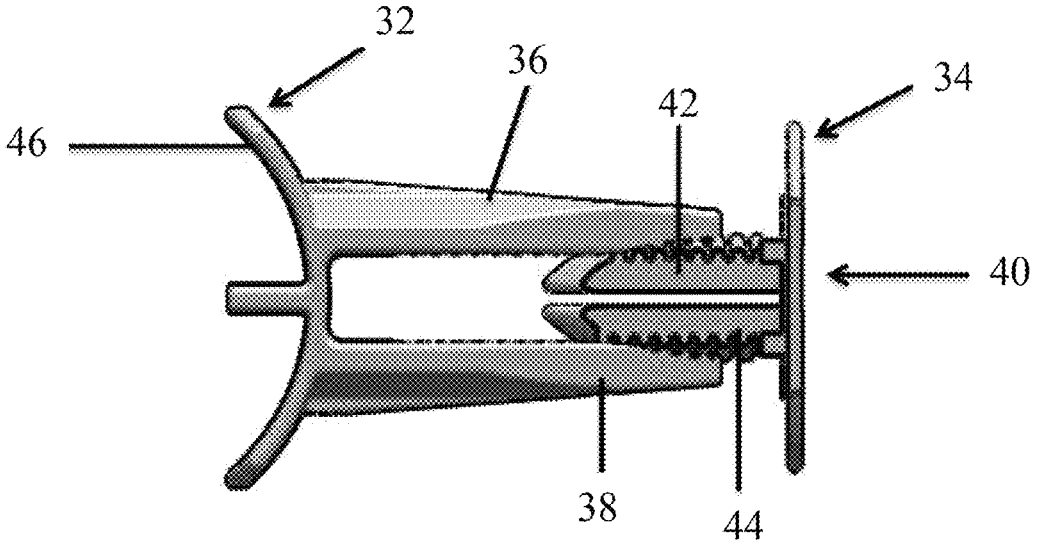
FIG. 7 illustrates a side view.
Figure 8:
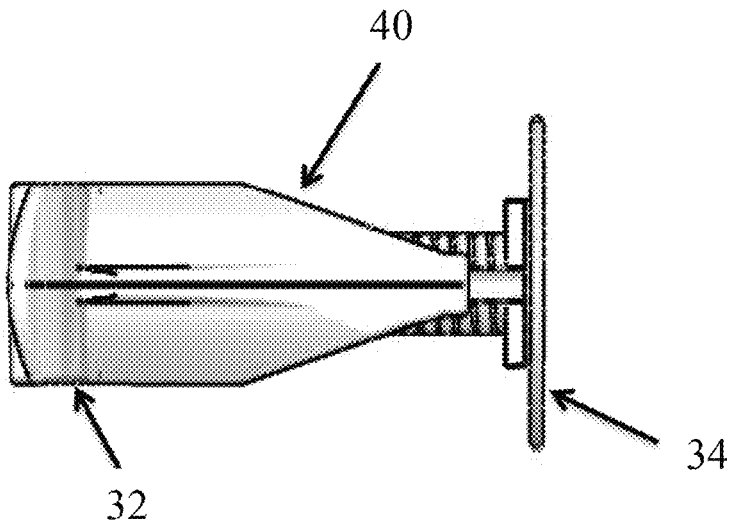
FIG. 8 illustrates a top view.
Figure 9:
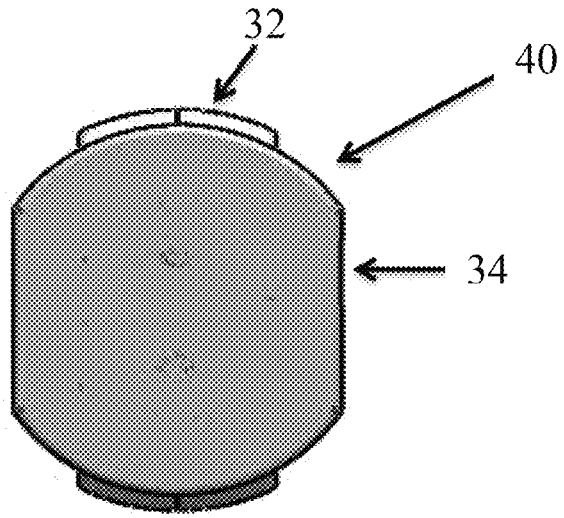
FIG. 9 illustrates an end view of the component portions of the temporary door latch device of the present invention.

FIG. 6 illustrates a perspective view, FIG. 7 illustrates a side view, FIG. 8 illustrates a top view and FIG. 9 illustrates an end view of the device 40 showing the female portion 32 engaged with the male portion 34 apart from the door and casing. The female portion 32 includes a pair of opposed and spaced apart resilient fingers 36 and 38. The fingers 36 and 38 each have a plurality of inwardly extending teeth thereon. The fingers 36 and 38 extend from an arcuate base 48, which mates with the door lock cylinder opening 24.

The male portion 34 has a pair of opposed and spaced apart fingers 42 and 44. The fingers 42 and 44 each have a plurality of outwardly extending teeth. The teeth on the fingers 36 and 38 of the female portion mate with the teeth on the fingers 42 and 44 when the portions 32 and 34 are engaged with each other. The fingers 42 and 44 of the female portion are slightly resilient and flex to receive the fingers of the male portion.

The opposed fingers 36 and 38 of the female portion extend from an arcuate base 46. The male and female portions are shown engaged with each other in FIGS. 5 through 8, which latches or locks the door 12 to the casing.

Figure 10:
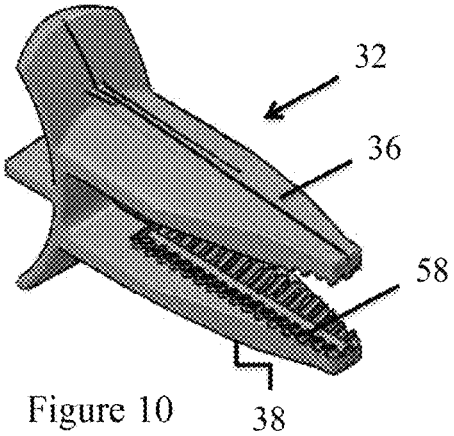
FIG. 10 illustrates a perspective view.
Figure 11:
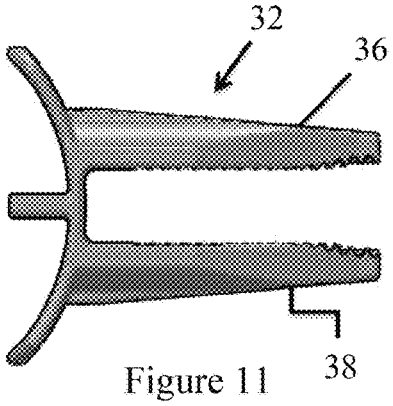
FIG. 11 illustrates a side view.
Figure 12:
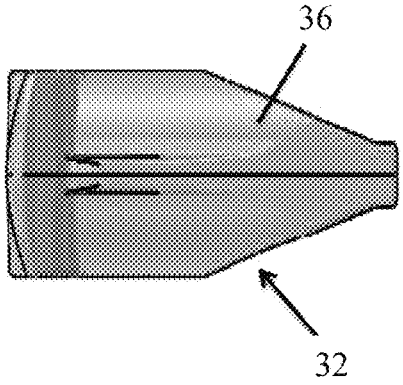
FIG. 12 illustrates a top view.
Figure 13:
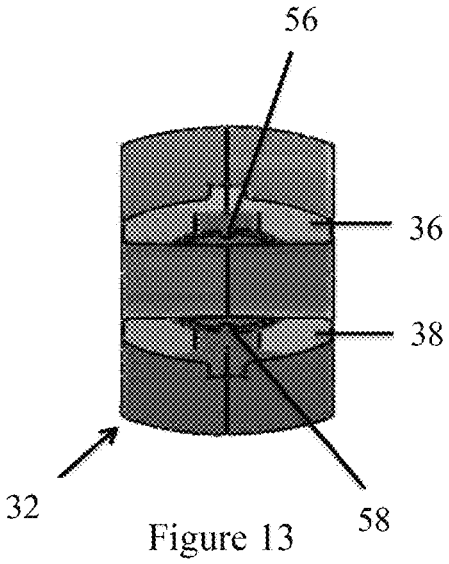
FIG. 13 illustrates an end view of a female portion of the temporary latch device.

FIG. 10 illustrates a perspective view, FIG. 11 illustrates a side view, FIG. 12 illustrates a top view and FIG. 13 illustrates an end view of the female portion 32 of the temporary door latch device 40 apart from the male portion 34 and apart from installation in the door 12 and casing.

In a preferred embodiment, the teeth on the fingers 36 and 38 of the female each include an alignment groove 56 and 58.

Figure 14:
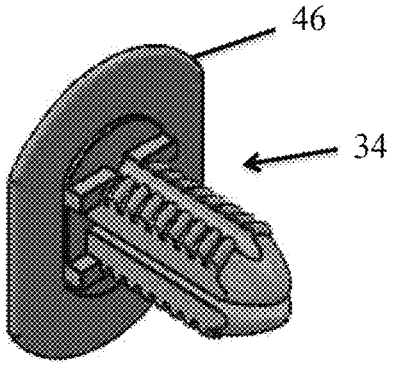
FIG. 14 illustrates a perspective view.
Figure 15:
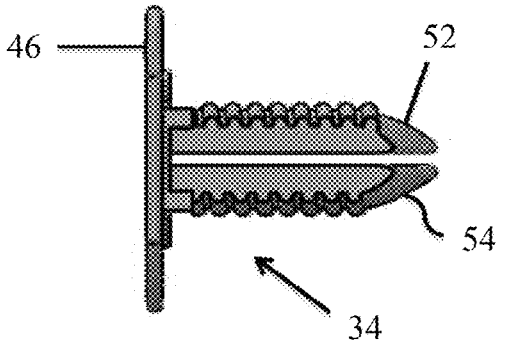
FIG. 15 illustrates a side view.
Figure 16:
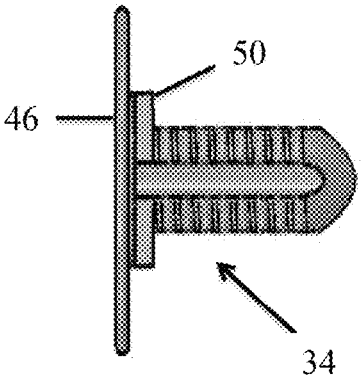
FIG. 16 illustrates a top view.
Figure 17:
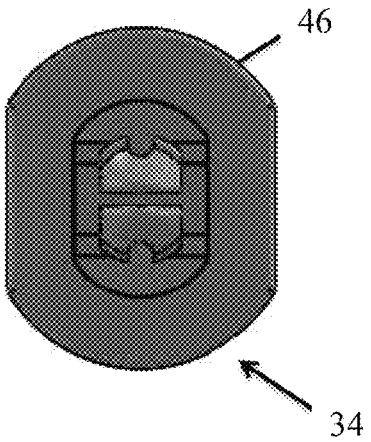
FIG. 17 illustrates an end view of a male portion of the temporary door latch device.

FIG. 14 illustrates a perspective view, FIG. 15 illustrates a side view, FIG. 16 illustrates a top view and FIG. 17 illustrates an end view of the male portion 34 of the temporary door latch device 40 apart from the female portion 32. Outwardly extending teeth on each of the fingers 42 and 44 are visible. The fingers 42 and 44 extend from a base 46 having a larger diameter than the latch bolt opening 28. Accordingly, when the male portion is inserted into the latch bolt opening, the base acts as a stop against side 18.

A block 50, or a series of posts forming a block, between the fingers 42 and 44 of the male portion 34 and the base 46 form a rectangular projection. The block 50 is receivable in the opening through the side jamb casing or latch bolt opening 28. A block 50 has a rectangular cross section. The dimension from one corner to the other corner of the block 50 is larger than the diameter opening of the latch bolt opening 28. Accordingly, although the block 50 is receivable in the latch bolt opening rotation of the male portion 34 is prohibited.

Each of the fingers 42 and 44 also include a tip or nose 52 and 54 extending therefrom.

The tips or noses 52 and 54 are received in alignment grooves 56 and 58 in the teeth of the fingers 36 and 38 of the female portion. Accordingly, the male portion and the female portion are self-aligning with each other.

In order to temporarily latch the pre-hung door and casing, the female portion 32 is initially inserted into the door lock cylinder opening 24 and into the door latch opening 26. The fingers 36 and 38 of the female portion extend into the door latch opening and the arcuate base 48 mates with the door lock cylinder opening 24. Thereafter or before, the male portion 34 is inserted into the door bolt opening 28 and into the door latch opening 26. The tips or noses 52 and 54 of the male portion 34 align with the alignment grooves 56 and 58 of the female portion 32 so that the portions self-align with each other. The teeth on the fingers of the female portion engage the teeth on the fingers of the male portion in one rotational orientation in order to latch the pre-hung door and casing together.

In order to disengage the female portion from the male portion, the female portion 32 is rotated approximately one quarter turn or ninety degrees (90°). Accordingly, the teeth are no longer engaged and the female portion may be retracted and removed.

In the event that the male portion 34 is accessible once installed, the male portion can be removed by withdrawing. If the male portion is not accessible, the fingers of the male portion 34 may be easily broken off so that they will fall away.

The present invention provides a self-aligning temporary door latch device 40 for a pre-hung door and casing which can easily be moved between a latched position and an unlatched position.

While the invention has been described with a certain degree of particularity, it is to be noted that many modifications may be made in the details of the invention's construction and the arrangement of its components without departing from the spirit and scope of this disclosure. It is understood that the invention is not limited to the embodiments set forth herein for purposes of exemplification.

Whereas, the present invention has been described in relation to the drawings attached hereto, it should be understood that other and further modifications, apart from those shown or suggested herein, may be made within the spirit and scope of this invention.

What is claimed is:

1. A temporary door latch device for a pre-hung door and casing, wherein said door has a door lock cylinder opening and a door latch opening and wherein said casing has a latch bolt opening, which device comprises:

a female portion having a pair of opposed and spaced apart resilient fingers, each of said fingers having a plurality of inwardly extending teeth thereon, said female portion receivable in said door lock cylinder opening and said door latch opening;

a male portion having a pair of opposed and spaced apart fingers, each of said fingers having a plurality of teeth thereon, said male portion receivable in said latch bolt opening and said door latch opening wherein said fingers of said male portion extend from a base of said male portion, said base being larger than said latch bolt opening, and said latch device further including a block formed between said fingers of said male portion and said base, said block receivable in said door latch opening whereby rotation of said male portion is prohibited by the size and shape of the block; and wherein said teeth on said female portion engage said teeth on said male portion in one rotational orientation, and wherein said teeth on said female portion are disengaged from said teeth on said male portion in another rotational orientation.

2. A temporary door latch device as set forth in claim 1 wherein said opposed fingers of said female portion extend from an arcuate base which mates with said door lock cylinder opening.

3. A temporary door latch device as set forth in claim 1 wherein said female portion is rotatable in said door lock cylinder opening and said door latch opening between said one rotational orientation and said another rotational orientation.

4. A temporary door latch device as set forth in claim 3 wherein said female portion is rotatable approximately ninety degrees (90°) between said one rotational orientation and said another rotational orientation.

5. A temporary door latch device as set forth in claim 1 wherein said male portion has a tip or nose extending from each of said pair of fingers.

6. A temporary door latch device as set forth in claim 5 wherein each of said fingers in said female portion includes an alignment groove.

7. A door latch device for a pre-hung door and casing, wherein said door has a door lock cylinder opening and a door latch opening and wherein said casing has a latch bolt opening, which device comprises:

a female portion having a pair of opposed and spaced apart resilient fingers, each of said fingers having a plurality of inwardly extending teeth thereon, said female portion receivable in said door lock cylinder opening and said door latch opening;

a male portion having a pair of opposed and spaced apart fingers, each of said fingers having a plurality of teeth thereon, said male portion receivable in said latch bolt opening and said door latch opening wherein said fingers of said male portion extend from a base of said male portion, said base being larger than said latch bolt opening, and said latch device further including a block formed between said fingers of said male portion and said base, said block receivable in said door latch opening whereby rotation of said male portion is prohibited by the size and shape of the block; and wherein said teeth on said female portion engage said teeth on said male portion to retain said door and casing together, and wherein said teeth on said female portion are disengaged from said teeth on said male portion to release said door from said casing.

8. A door latch device as set forth in claim 7 wherein said opposed fingers of said female portion extend from an arcuate base which mates with said door lock cylinder opening.

* * * * *